US009180896B2

(12) United States Patent
Berg et al.

(10) Patent No.: US 9,180,896 B2
(45) Date of Patent: Nov. 10, 2015

(54) SIGNAL TRANSMITTER

(75) Inventors: Eike Berg, Berlin (DE); Andre Gruettner, Berlin (DE); Norbert Poepplow, Eichwalde (DE); Olaf Vogt, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 67 days.

(21) Appl. No.: 14/235,509

(22) PCT Filed: Jul. 5, 2012

(86) PCT No.: PCT/EP2012/063121

§ 371 (c)(1),
(2), (4) Date: Jan. 28, 2014

(87) PCT Pub. No.: WO2013/013948

PCT Pub. Date: Jan. 31, 2013

(65) Prior Publication Data

US 2014/0166822 A1 Jun. 19, 2014

(30) Foreign Application Priority Data

Jul. 28, 2011 (DE) ..... 10 2011 080 040

(51) Int. Cl.

| | |
|---|---|
| ***G08B 5/22*** | (2006.01) |
| ***B61L 23/00*** | (2006.01) |
| ***B61L 5/18*** | (2006.01) |
| *H05B 31/00* | (2006.01) |
| *G08B 1/00* | (2006.01) |

(52) U.S. Cl.

CPC ..... *B61L 23/00* (2013.01); *B61L 5/1881* (2013.01); *G08B 1/00* (2013.01); *H05B 31/00* (2013.01)

(58) Field of Classification Search

CPC ..... G08B 1/00; H05B 31/00
USPC ..... 340/815.45
See application file for complete search history.

(56) References Cited

U.S. PATENT DOCUMENTS

| | | | | |
|---|---|---|---|---|
| 6,392,553 | B1 | 5/2002 | Mollet et al. | |
| 6,956,494 | B2 | 10/2005 | Tichborne et al. | |
| 2007/0228223 | A1 * | 10/2007 | Dittmar et al. | 246/28 R |

FOREIGN PATENT DOCUMENTS

| | | | |
|---|---|---|---|
| DE | 3515962 | C2 | 2/1987 |
| DE | 102006017628 | A1 | 10/2007 |
| EP | 1324641 | A2 | 7/2003 |
| EP | 1741613 | A1 | 1/2007 |
| EP | 2146551 | A2 | 1/2010 |
| WO | 2004039649 | A1 | 5/2004 |

OTHER PUBLICATIONS

Schuermanns P., "ZSB 2000—Serielle Signalsteuerung", Signal + Draht, Telzlaff Verlag GmbH, DE Nr. 1/02, 2007, pp. 31-37, XP001504136, ISSN: 0037-4997.

* cited by examiner

*Primary Examiner* — Shirley Lu
(74) *Attorney, Agent, or Firm* — Laurence A. Greenberg; Werner H. Stemer; Ralph E. Locher

(57) ABSTRACT

A signal transmitter contains at least one first luminous element, at least one second luminous element and an interface for connecting the signal transmitter to a signal box. A drive device is connected between the interface and the at least two luminous elements and the drive device is configured in such a way that, in the case of a switch-on signal coming from the signal box for the second luminous element, the drive device controls the activation of the luminous element depending on the signaling state of the first luminous element.

10 Claims, 7 Drawing Sheets

SIGNAL TRANSMITTER

BACKGROUND OF THE INVENTION

Field Of The Invention

The invention relates to a signal transmitter comprising at least one first luminous element and at least one second luminous element and an interface for connecting the signal transmitter to a signal box. The signal box can be a railway signal box but can also be any other facility which enables a signal transmitter to be set or adapted.

Signal transmitters of the described type are used in particular in the field of railway technology. With railway technology, signal aspects with varying order ratings are generally assigned to the luminous elements. If one signal aspect is of higher order than another signal aspect, this means that it indicates an unsafe operating state. A signal aspect "proceed" is thus of higher order than a signal aspect "stop", because a stop signal leads to the railway vehicle or vehicles stopping and thus an accident is less probable than with a "proceed" signal.

BRIEF SUMMARY OF THE INVENTION

The object underlying the invention is to specify a signal transmitter, which allows for a particularly reliable switchover of the signaling of the signal transmitter.

This object is achieved according to the invention by a signal transmitter having the features according to the main claim. Advantageous embodiments of the inventive signal transmitter are specified in the sub claims.

Provision is then made in accordance with the invention to connect a drive device between the interface and the at least two luminous elements, and the drive device is embodied such that in the event of a switch-on signal coming from the signal box for the second luminous element, it controls activation of this luminous element as a function of the signaling state of the first luminous element.

One significant advantage of the inventive signal transmitter is that the signal transmitter can autonomously decide on the actuation of the luminous elements and can implement a switchover process as a function of order ratings and signaling states, because the drive device is connected between the interface of the signal transmitter and the at least two luminous elements. This is to be clarified with the aid of an example. If for instance a low-order signal aspect and a conversely higher-order signal aspect are assigned to the first and the second luminous elements respectively, in accordance with the invention the switching-on of the higher-order signal aspect would be dependent on the signaling state of the low-order signal aspect. If control commands originate from the signal box for instance in order to switch on both signal aspects, the signal transmitter can autonomously interrupt the activation of the higher-order signal aspect, for instance provided the signal box has switched off the switch-on signal of the low-order signal aspect and only a control signal for switching on the higher-order signal aspect is still present on the signal box side. In this example, therefore, a double signaling of two signal aspects can be prevented and reliability increased, because a misinterpretation of the signal aspect by an observer can be prevented. Nevertheless, the functional efficiency of both luminous elements and/or both signal aspects can be reported to the signal box from the drive device, since in accordance with the invention this is connected between the interface of the signal transmitter and the two luminous elements and a separation thus exists between the luminous elements and the interface. The drive device can therefore report something else to the signal box than is actually indicated by the luminous elements, this not being possible with signal transmitters in which the signal box has a direct effect on the luminous elements.

A further significant advantage consists in the luminous color of the two luminous elements possibly being different in the inventive signal transmitter because a double signaling and/or a simultaneous signaling of two colors and a mixed color formation can be prevented on account of the signaling-state-dependent mode of operation of the signal transmitter. Multi-colored signal transmitters can thus also be connected to signal boxes, whereby, in the event of switchover processes, two signal aspects (or the corresponding luminous elements) are activated as standard for a transition time by switching on an operating voltage on the signal box side. An acknowledgement to the signal box such that both signal aspects can be activated can consequently take place by means of the interposed drive device, although only one signal color actually illuminates. The inventive signal transmitter can therefore, without modification, also be connected to signal boxes with temporary double signaling.

With a particularly preferred embodiment of the signal transmitter, provision is made for a first signal aspect and a second signal aspect to be assigned to the first luminous element and the second luminous element respectively, wherein the second signal aspect is of higher order than the first signal aspect.

The prioritization of the signal aspects performed by the drive device of the signal transmitter is preferably encoded using hardware, for instance by a corresponding electrical 'wiring' (connection-programmed controller', e.g. by logical circuits (logical gates) which are connected correspondingly to one another). Alternatively, the prioritization can be defined by a corresponding programming of a programmable controller (SPS), which includes a programmable processor for instance. In the latter case, the prioritization is preferably stored in the form of a parameter set, for instance in the form of a priority table, in the memory of the programmable controller.

The drive device can therefore include a wire-programmed controller and/or a programmable controller (SPS) in order to be able to execute the described functions. The prioritization or mode of operation of the drive device is in this way preferably a captive 'component' or a captive property of the signal transmitter.

The luminous color of the two luminous elements is preferably different, but can however also be identical.

The drive device is preferably embodied such that in the event of a switch-on signal coming from the signal box for the second luminous element, when the first luminous element is already switched on, it leaves the first luminous element switched on and the second luminous element switched off and generates an acknowledgement (e.g. in the form of acknowledgement signals) on the interface, which indicates the operation (and/or operational readiness) of both luminous elements to the signal box, although the second luminous element is still switched off.

In respect of a switchover in another direction, in other words from a higher-order signal aspect to a low-order signal aspect or with a switchover from the second luminous element to the first luminous element, the drive device will preferably perform the switchover directly and switch off the second luminous element and switch on the first luminous element. Such a procedure ensures that the safe signal aspect is immediately realized, if a request is made on the signal box side, independently of the control signals on the signal box side for switching on the second luminous element.

The drive device particularly preferably includes a lamp control module and an acknowledgement module connected to the lamp control module, wherein the lamp control module is embodied such that in the event of a switch-on signal coming from the signal box for the second luminous element, when the first luminous element is already switched on, it leaves the first luminous element switched on and the second luminous element switched off, and wherein the acknowledgement module is embodied such that it generates an acknowledgement to the interface in this case, which indicates the operation and/or operational readiness of both luminous elements to the signal box, although the second luminous element (with a switched-on first luminous element) is still switched off.

The drive device is preferably embodied such that it only switches on the second luminous element if it receives a signal for switching off the first luminous element from the signal box.

Furthermore, it is considered to be advantageous if the drive device is embodied such that in the event of the presence, for longer than a predetermined period of time, of control signals on the signal box side for switching on both luminous elements, it generates an error signal for the signal box (on the interface).

The drive device will preferably generate the error signal on the control line on the signal box side (subsequently also abbreviated to signal box line) for the luminous element assigned to the second signal aspect.

It is also considered to be advantageous if the signal transmitter has at least one further luminous element for indicating a signal aspect, the quality rating of which lies between that of the second signal aspect and that of the first signal aspect, and the drive device is embodied such that in the event of the presence of switch-on signals on the signal box side for three or more luminous elements, it generates an error signal for the signal box on the interface.

In the latter case, the drive device will generate an error signal preferably on all control lines (signal box lines) on the signal box side, on which switch-on signals are present on the signal box side, with the exception of the control line on the signal box side for the luminous element which is assigned to the lowest-order signal aspect.

In the event of the presence of switch-on signals (control signals for switching on) on the signal box side for three or more luminous elements, the drive device will preferably only activate the luminous element which is assigned to the lowest-order signal aspect.

Furthermore, it is considered to be advantageous if the signal transmitter allows for daytime and nighttime signaling and the drive device generates an error signal if, at the same time, a signaling exists for daytime and nighttime operation.

The invention also relates to a railway system with a signal transmitter, as described above, and a railway signal box connected to the signal transmitter.

The invention also relates to a method for operating a signal transmitter having at least two luminous elements and an interface which is connected to a signal box. Provision is made in accordance with the invention for a drive device connected between the interface and the at least two luminous elements, in the event of a control signal coming from the signal box for switching on the luminous element assigned to the second signal aspect, to control activation of this luminous element as a function of the respective signaling state of the first luminous element.

In respect of the advantages of the inventive method, reference is made to the afore-cited advantages of the inventive signal transmitter, since the advantages of the inventive signal transmitter substantially correspond to those of the inventive method.

The invention is described in more detail below with the aid of exemplary embodiments, in which, by way of example

DESCRIPTION OF THE INVENTION

Figure 1:
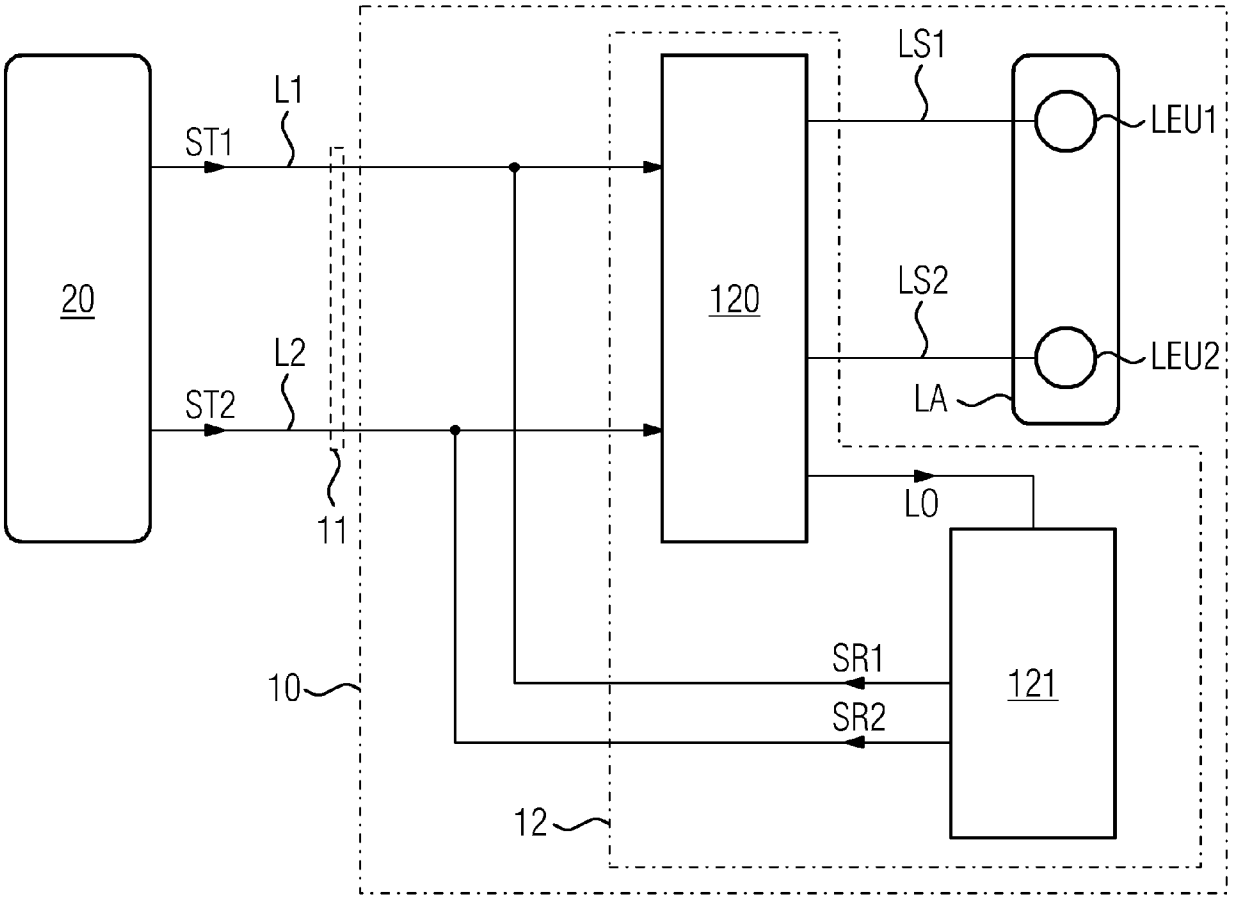
FIG. 1 shows an exemplary embodiment of a signal transmitter with two luminous elements.

For the sake of clarity, the same reference characters are always used in the figures for identical or comparable components.

FIG. 1 shows an arrangement with a signal transmitter 10, which is connected to signal box lines L1 and L2 by way of an interface 11. The interface 11 of the signal transmitter 10 and thus the signal transmitter is connected to a signal box 20 by way of these two signal box lines.

The signal transmitter 10 includes a luminous arrangement LA, which is equipped with a first (for instance red) luminous element LEU1 and a second (for instance green) luminous element LEU2. A first signal aspect, which is to be indicated by the first luminous element (LEU1), is assigned to the first luminous element LEU1. With this and also with the further exemplary embodiments, it is assumed by way of example that the first signal aspect is only to be indicated by a single first luminous element LEU1. A plurality of further ("first") luminous elements, which are actuated in parallel or together with the first luminous element LEU1 and together herewith indicate the first signal aspect, can naturally be assigned to the first signal aspect.

A second signal aspect is assigned to the second luminous element LEU2; the second luminous element LEU2 is therefore determined so as to indicate this second signal aspect by means of illumination. With this and also with the further exemplary embodiments, it is assumed by way of example that the second signal aspect is only to be indicated by a single second luminous element LEU2. A plurality of further ("second") luminous elements can naturally be assigned to the second signal aspect, which are actuated in parallel or together with the second luminous element LEU2 and together herewith indicate the second signal aspect.

It is then assumed by way of example that the second signal aspect, which is to be indicated by the second luminous element LEU2, is of higher order than the first signal aspect, which is indicated by the first luminous element LEU1. A higher-order signal aspect is understood here to mean a signal aspect which indicates an un safer signal state than a contrastingly lower-order signal aspect. If there is therefore uncertainty as to whether an even higher-order or a lower-order signal aspect is to be indicated, the arrangement shown in FIG. 1 will always aim to indicate the lower-order signal aspect since this indicates the un safer state. The priority of the first signal aspect is thus higher than the priority of the second signal aspect, since the first signal aspect is of lower order than the second signal aspect.

The first (low-order) signal aspect can be the signal aspect ("stop") for instance, which is indicated by the first luminous element LEU1 with a red light. The second (higher-order) signal aspect can be the signal aspect ("proceed") for instance, which is indicated by the second luminous element LEU2 with a green light.

It is apparent in FIG. 1 that the luminous arrangement LA is not directly connected to the interface 11 of the signal transmitter 10. Instead, the luminous arrangement LA is separated from the interface 11 by means of a drive device 12, which includes a lamp control module 120 and an acknowledgement module 121 for instance.

The lamp control module 120 is connected to the interface 11 and thus to the two signal box lines L1 and L2 so that it can receive control signals ST1 and/or ST2 from the signal box 20 by way of the signal box lines. The lamp control module 120 has the task of evaluating the control signals transmitted by way of the signal box lines L1 and L2 and actuating the two luminous elements LEU1 and LEU2 by way of the lamp control lines LS1 and LS2. The luminous elements are actuated here as a function of the respective signaling state which the luminous arrangement LA assumes. The mode of operation of the lamp control module 120 is explained in more detail below.

The acknowledgement module 121 is connected to the lamp control module 120 and is actuated hereby by way of one or more control lines, of which only one is shown in FIG. 1 for the sake of clarity and is identified with the reference character LO.

The acknowledgement module 121 has the task of generating acknowledgement signals SR1 and SR2 and transmitting these via the signal box lines L1 and L2 to the signal box 20. The signal box 20 receives an acknowledgement message about the respective state of the signal transmitter 10 by way of the acknowledgement signals SR1 and SR2, wherein the state signaled by the signal transmitter 10 and/or by the acknowledgement module 121 to the signal box 20 need not necessarily correspond to the luminous state of the luminous arrangement LA, as explained in more detail below.

Figure 2:
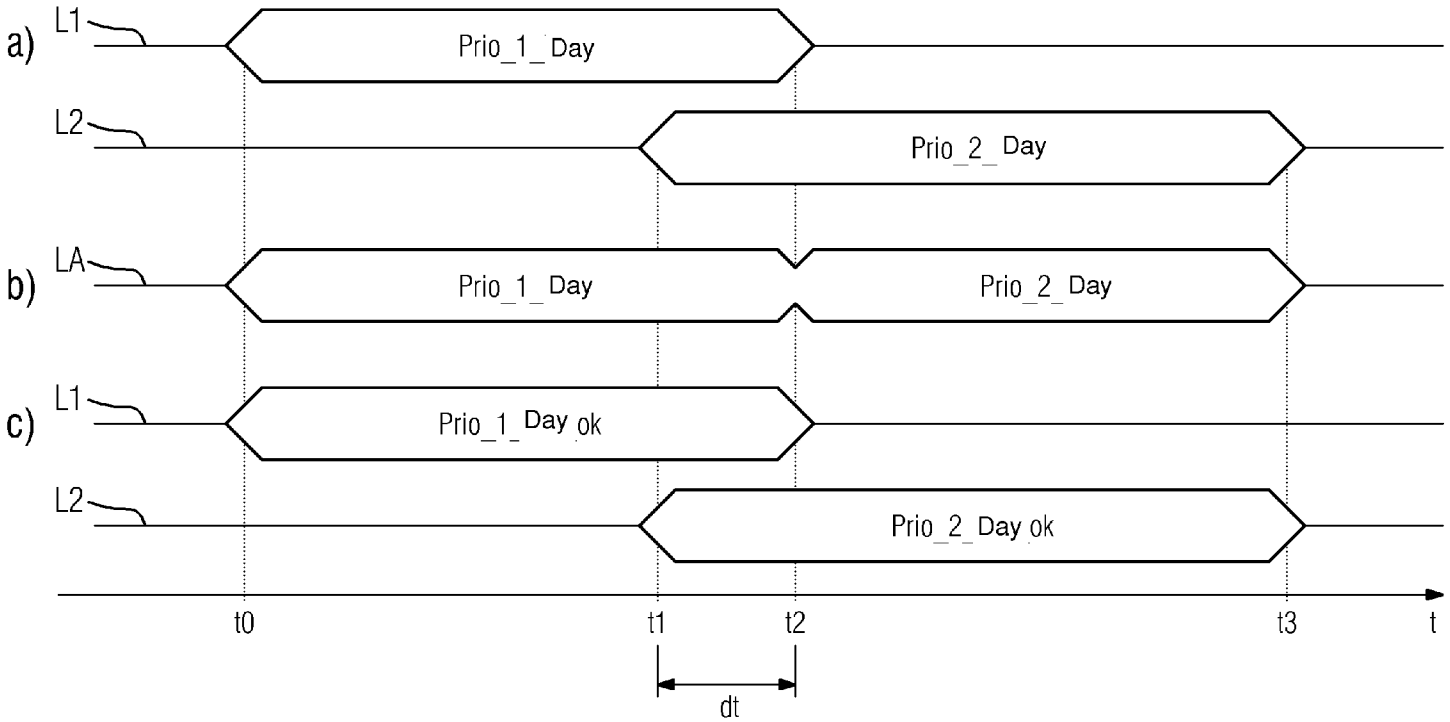
FIG. 2 shows the mode of operation of the signal transmitter according to FIG. 1 in the error-free case.

FIG. 2 shows by way of example the mode of operation of the signal transmitter 10 and the acknowledgement signals sent back to the signal box 20 by the signal transmitter 10, if a switchover from the first luminous element LEU1 to the second luminous element LEU2 takes place in an error free manner.

An upper section "a)" in FIG. 2 shows how control signals are transmitted by way of the signal box lines L1 and L2 from the signal box 20. At time instant t0, the signal box thus begins to transmit a control signal with the control command "Prio_1_Day" to the signal transmitter 20 by way of the signal box line L1. No control command is transmitted at this time instant by way of the signal box line L2.

Section "b)" in FIG. 2 shows how the drive device of the signal transmitter 10 actuates the luminous arrangement LAQ such that according to the control command "Prio_1_Day" the first luminous element LEU1 illuminates. The first signal aspect is indicated with the luminous element LEU1.

At a subsequent time instant t1, the signal box additionally transmits a control signal with the control command "Prio_2_Day" on the signal box line L2, with which the second luminous element LEU2 of the luminous arrangement LA is to be activated. From time instant t1 to time instant t2, two control commands "Prio_1_Day" and "Prio_2_Day" are thus present on the signal transmitter 10, with which the signal box would like to activate both luminous elements LEU1 and LEU2 at the same time.

As apparent in section "b)" of FIG. 2, only the first luminous element LEU1 is however still activated by the luminous arrangement LA in the time interval between the time instants t2 and t1, this being indicated in FIG. 2 by specifying the corresponding control command "Prio_1_Day". Although activation of both luminous elements LEU1 and LEU2 is therefore desired on the signal box side, only the first luminous element LEU1 is activated by the drive device of the signal transmitter 10, because namely the first luminous element LEU1 is used to indicate the lower-order signal aspect. If control commands for indicating two signal aspects exist, the signal transmitter 10 will indicate only the lower-order signal aspect. The higher-order signal aspect is not indicated.

FIG. 2 furthermore shows in section "c" how the acknowledgement to the signal box is performed by way of the signal box lines L1 and L2. It is apparent that both an acknowledgement signal with the acknowledgement information "Prio_1_Day_ok" and also an acknowledgement signal with the acknowledgement information "Prio_2_Day_ok" is transmitted by way of the signal box line L1.

It is therefore indicated to the signal box by way of the acknowledgement signals having both acknowledgement information "Prio_1_Day_ok" and "Prio_2_Day_ok" that both the first luminous element LEU1 and also the second luminous element LEU2 are ready for operation. After receiving the corresponding acknowledgment signals or after receiving the corresponding acknowledgement information "Prio_1_Day_ok" or "Prio_2_Day_ok", the signal box 20 will shut off the first luminous element LEU1 by way of the signal box line L by shutting off the signal command "Prio_1_Day" at time instant t2. Only the control command "Prio_2_Day" thus still exists at the signal transmitter 10, said control command being transmitted via the control signal ST2 from the signal box line L2. As soon as the control command "Prio_1_Day" has been switched off on the signal box side, the drive device 12 according to FIG. 1 will switch off the first luminous element LEU1 and switch on the second luminous element, in other words the control command "Prio_2_Day", which is transmitted by way of the signal box line L2. The corresponding switchover from the first luminous element LEU1 to the second luminous element LEU2 is shown in section "b)" in FIG. 2.

After switching over from the first luminous element LEU1 to the second luminous element LEU2, the acknowledgement signal SR1, which is transmitted by way of the signal box line L1 to the signal box, is switched off, by the transmission of the acknowledgement information "Prio_1_Day_ok" being switched off.

From time instant t2, only the second luminous element LEU2 according to the control command "Prio_2_Day" is thus indicated on the luminous arrangement LA.

Figure 3:
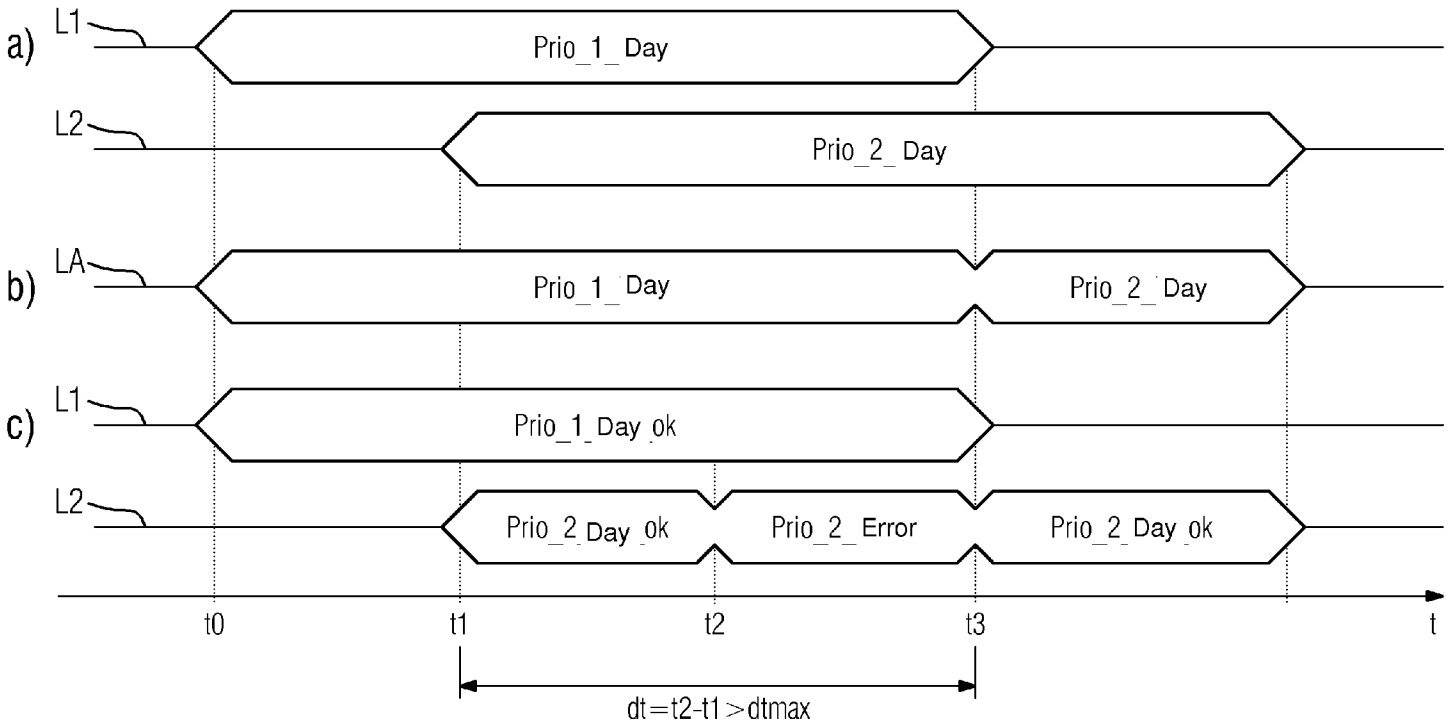
FIG. 3 shows the mode of operation of the signal transmitter according to FIG. 1 in the event of an excessively long double signaling.

Here FIG. 3 shows the mode of operation of the signal transmitter 10 according to FIG. 1 in the event of an error; it is assumed here by way of example that the time span, during which diverging and/or deviating control commands are transmitted on the two signal box lines L1 and L2, exceeds a predetermined maximum duration dtmax.

It is apparent in FIG. 3 that at time instant t0 the control command "Prio_1_Day" is transmitted from the signal box by way of the signal box line L1, with which control command the first luminous element LEU1 of the luminous arrangement LA is to be switched on. Accordingly, the signal transmitter 10 according to FIG. 1 will also perform the signaling and switch the first luminous element LEU1 on on the luminous arrangement LA. The corresponding switching-on is visualized in section "b)" of FIG. 3 by specifying the control command "Prio_1_Day".

The signal transmitter 10 will furthermore send an acknowledgement signal SR1 with the acknowledgement information "Prio_1_Day_ok" to the signal box 20 on the signal box line L1, so that a correct mode of operation of the signal transmitter 10 is indicated to the signal box 20.

If now at time instant t1 the control signal ST2 with the control command "Prio_2_Day" is also transmitted via the signal box line L2 to the signal transmitter 10, it will, as already mentioned in connection with FIG. 2, initially remain in a signaling of the first signal aspect by the first luminous element LEU1. This is indicated in section "b)" of FIG. 3 by specifying the control command "Prio_1_Day".

The signal transmitter 10 will accordingly acknowledge receipt of the control command "Prio_2_Day", by transmitting the acknowledgement information "Prio_2_Day_ok" to the signal box on the signal box line L2. Positive acknowledgement information "Prio_1_Day_ok" and "Prior_2_Day_ok" thus exists at the signal box 20.

The drive device 12 of the signal transmitter 10 will monitor the time span in which two different control commands "Prio_1_Day" and "Prio_2_Day" exist at the interface 11 and will generate an error signal if a predetermined maximum time span dtmax is exceeded. It is then assumed that this maximum time duration dtmax is exceeded at time instant t2. Accordingly, the drive device 12 of the signal transmitter 10 will transmit acknowledgement information "Prio_2_Error" on the signal box line L2, with which the error of excessively long double signaling which has occurred is indicated to the signal box 20. Positive acknowledgement information "Prio_1_Day_ok" is still conversely indicated on the signal box line L1 since the luminous arrangement LA still correctly indicates the first signal aspect by means of the first luminous element LEU1.

The transmission of the acknowledgement information "Prio_2_Error" may ensue for instance because the acknowledgement information "Prio_2_Day_ok" is switched off. The signal box 20 namely expects, when transmitting the signal aspect "Prio_2_Day" via the signal box line L2, that the acknowledgement information "Prio_2_Day_ok" is sent back by the signal transmitter 10 as acknowledgement information. If this does not happen, the signal box knows that an error has occurred.

If the transmission of the control command "Prio_1_Day" is now terminated at time instant t3, only the control command "Prio_2_Day" on the signal box line L2 still exists on the signal transmitter 10. This control command can be realized immediately by the first luminous element LEU1 being switched off and the second luminous element LEU2 being switched on. A switchover is thus carried out from the first (lower-order) signal aspect to the second (even higher-order) signal aspect. This is visualized in FIG. 3 in section "b)" by specifying the signal aspect "Prio_2_Day".

Once the first signal aspect or the first luminous element LEU1 have been switched off, corresponding acknowledgment information is transmitted via the signal box line L1 to the signal box, by the acknowledgement information "Prio_1_Day_ok" being switched off at time instant t3.

Since, on account of the switching off of the first signal aspect, double signaling also no longer exists, an error signal no longer needs to be transmitted to the signal box by way of the signal box line L2. The signal transmitter 10 at time instant t3 will accordingly transmit positive acknowledgement information "Prio_2_Day_ok" to the signal box line L2, with which a correct display of the second signal aspect is indicated with the aid of the second luminous element LEU2.

Figure 4:
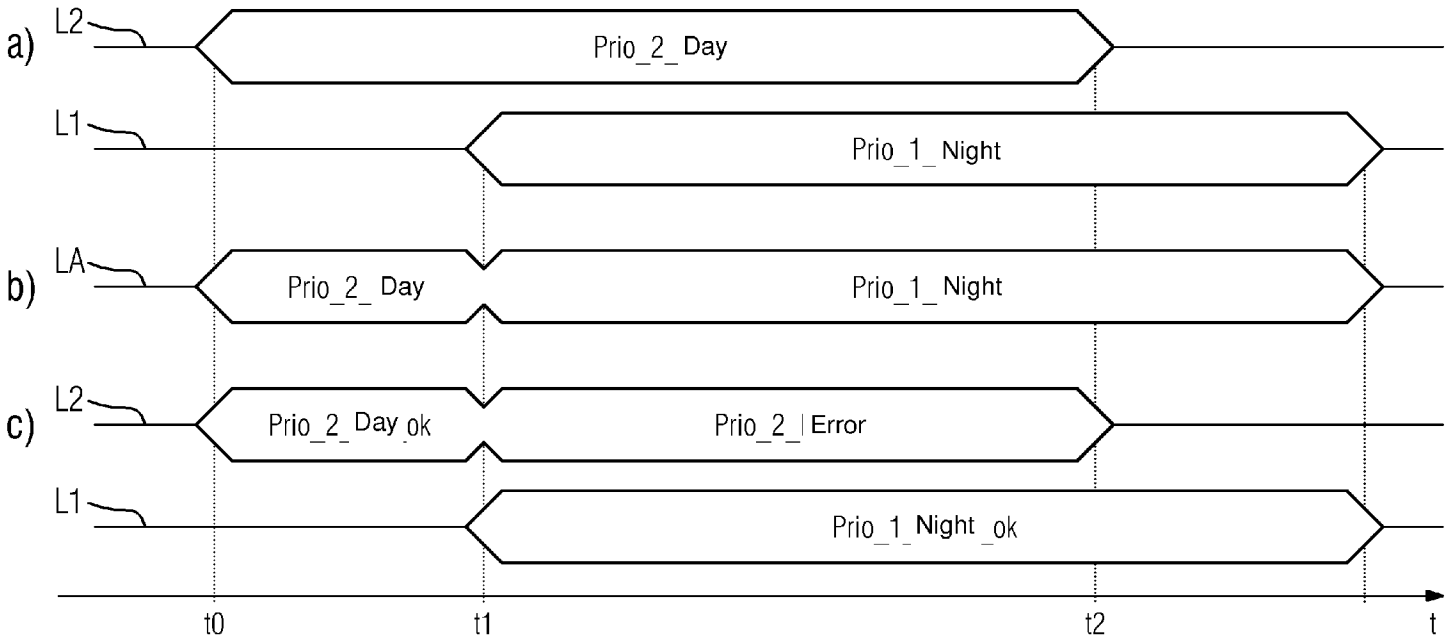
FIG. 4 shows the mode of operation of the signal transmitter according to FIG. 1 in the event of a switchover from daytime to nighttime operation.

FIG. 4 shows by way of example the mode of operation of the signal transmitter 10 according to FIG. 1, if the control command "Prio_2_Day" for setting the second signal aspect is transmitted by way of the signal box line L2 from the signal box 20 in the time span between time instants t1 and t0. It is apparent that the signal transmitter 10 executes the control command "Prio_2_Day" by correspondingly actuating the luminous arrangement LA, by switching on the second luminous element LEU2 of the luminous arrangement LA. A positive acknowledgement by displaying the second signal aspect takes place by way of the second signal box line L2 with the aid of the acknowledgement signal SR2, with which the acknowledgment information "Prio_2_Day_ok" is transmitted to the signal box.

If at time instant t1 transmission of not only the control command "Prio_2_Day" on the signal box line L2 but also of the control command "Prio_1_Night" on the signal box line L1 is started on the signal box side, the signal transmitter 10 will immediately, in other words already at time instant t1, switch over from the second signal aspect to the first signal aspect, since the first signal aspect has a higher priority because it has a lower order and defines a safer state.

At the same time the signal transmitter 10 will transmit an error signal to the signal box 20, by transmitting the acknowledgement information "Prio_2_Error" on the signal box line L2. The signal box 20 is thus notified by the signal transmitter 10 that the display of the first lower-order signal aspect takes place in "night mode", although transmission of the second signal aspect has previously taken place in "day mode". This acknowledgement message enables the signal box 20 to check whether a daytime signaling or a nighttime signaling is to take place.

The acknowledgement on the signal box line L2 takes place by sending the acknowledgement information "Prio_1_Night_ok", because the first signal aspect is actually shown in night mode on the luminous arrangement LA, such as corresponds to the control command "Prio_1_Night".

Once the transmission of the control command "Prio_2_Day" on the signal box line L2 is terminated at time instant t2 and only a transmission of the control command "Prio_1_Night" still takes place, the transmission of the acknowledgement information "Prio_2_Error" is stopped and only the acknowledgement information "Prio_1_Night_ok" is still transmitted, with which a correct display of the first signal aspect is signaled in night mode.

Figure 5:
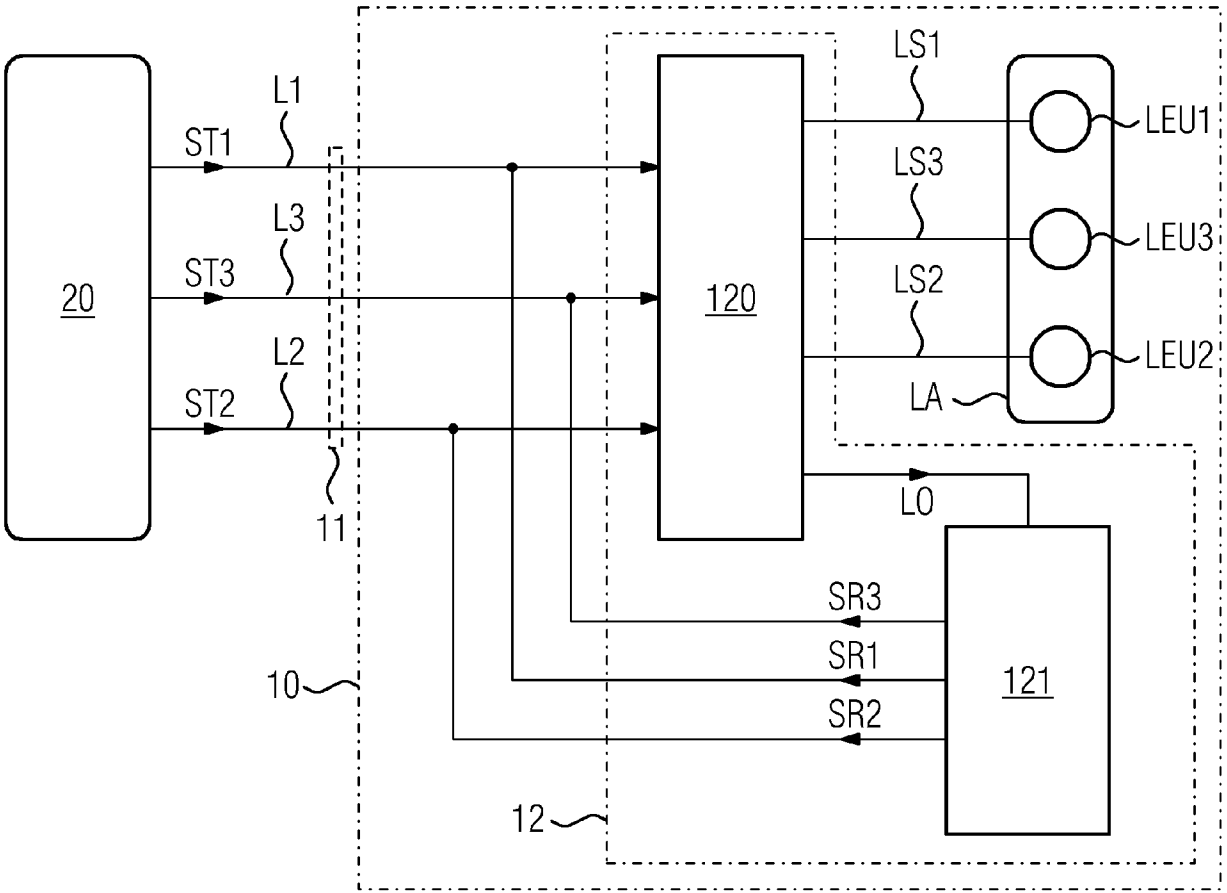
FIG. 5 shows an exemplary embodiment of a signal transmitter with three luminous elements.

FIG. 5 shows an exemplary embodiment of an arrangement, in which the signal transmitter 10 is connected to three signal box lines L1, L2, and L3 by way of its interface 11 and is thus connected to a signal box 20 by way of three signal box lines.

A luminous arrangement LA of the signal transmitter 10 has three luminous elements LEU1, LEU2 and LEU3, which are assigned in each instance to a predetermined signal aspect. In this case it is assumed for instance that the first luminous element LEU1 illuminates red and is assigned to the lowest-order signal aspect, the second luminous element LEU2 illuminates yellow and is assigned to an average-order signal aspect and the third luminous element LEU3 illuminates green and is assigned to the highest-order signal aspect.

The first luminous element LEU1 thus signals a particularly safe state, the second luminous element LEU2 signals an average state in respect of safety and the third luminous element LEU3 signals a particularly unsafe state, compared with the two other signal aspects.

Figure 6:
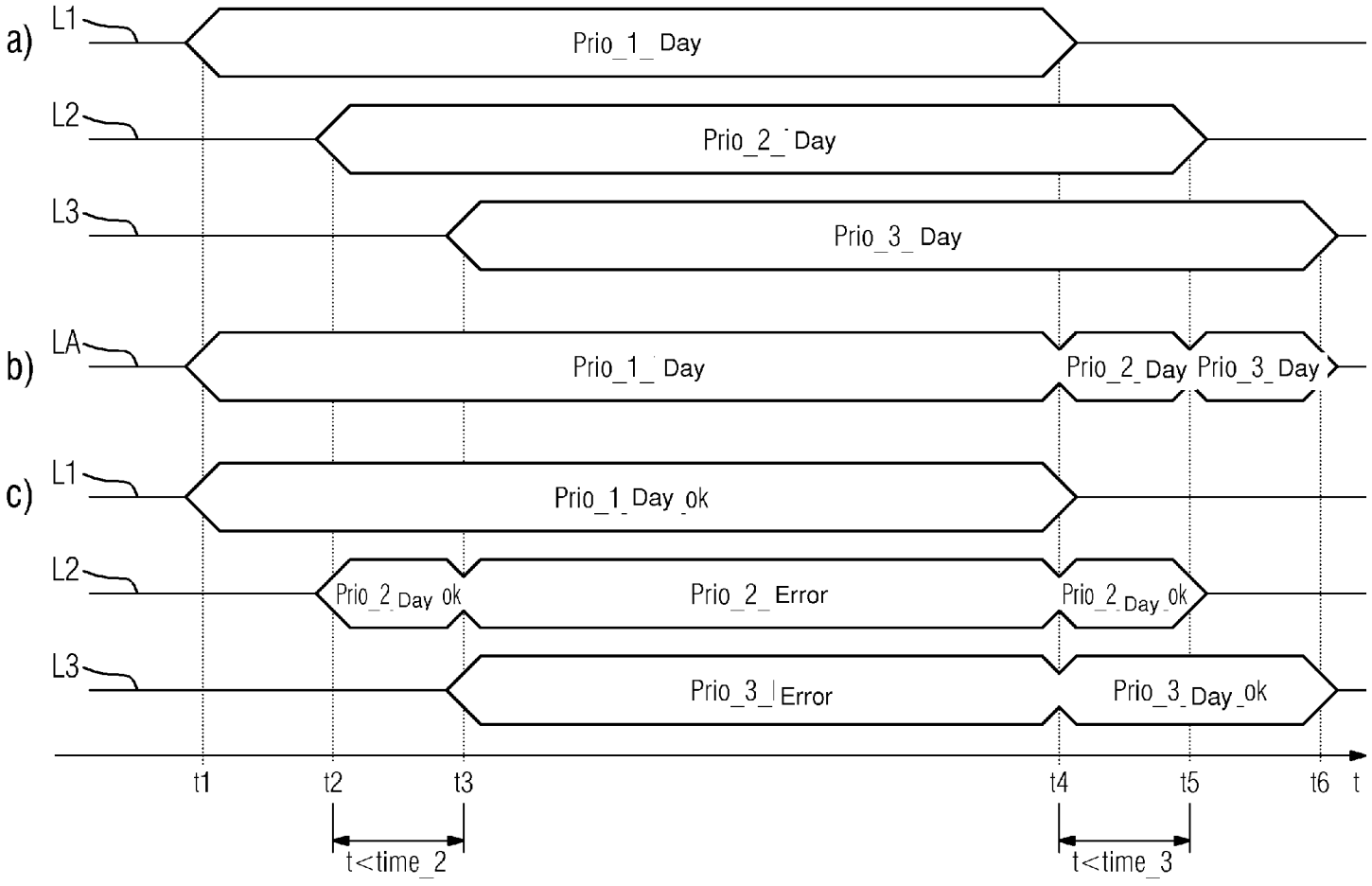
FIG. 6 shows the mode of operation of the signal transmitter according to FIG. 5 in the event of a triple signaling and FIG. 7 shows an exemplary embodiment of a signal transmitter with an acknowledgement module including a switch.

The mode of operation of the arrangement according to FIG. 5 is shown by way of example in FIG. 6. It is apparent that at time instant t1, a control command "Prio_1_Day" is transmitted via the signal box line L1 from the signal box to the signal transmitter 10. With this control command, the signal transmitter 10 is requested to switch on the first luminous element LEU1 on the luminous arrangement LA in order to display the first signal aspect.

It is apparent in FIG. 6 that the signal transmitter 10 immediately executes the control command "Prio_1_Day". It is thus apparent in section "b)" of FIG. 6 that the control command "Prio_1_Day" is executed on the luminous arrangement LA.

Section "c)" in FIG. 6 shows the acknowledgement which is transmitted from the signal transmitter 10 to the signal box 20. It is apparent that the acknowledgment information "Prio_1_Day_ok", with which the signal transmitter 10 indicates that the luminous arrangement LA or the first luminous element LEU1 correctly indicates the first signal aspect, is transmitted on the signal box line L1.

If at time instant t2 a simultaneous transmission of the control command "Prio_1_Day" and "Prio_2_Day" takes place, the signal transmitter 10 will further execute the control command "Prio_1_Day" on the luminous arrangement LA and will address the first luminous element LEU1, as a result of which the first signal aspect is indicated. The second signal aspect, which is called up by the control command "Prio_2_Day", is not executed, since the priority of the second signal aspect is less than the priority of the first signal aspect, since namely the second signal aspect is even higher-order than the first signal aspect.

The acknowledgment information, which is transmitted to the signal box 20, is shown in section "c)" of FIG. 6. It is clear in the time period between t2 and t3 on the signal box line L2 that acknowledgement information "Prio_2_Day_ok" is transmitted to the signal box 20. It is thus indicated to the signal box 20 that the control command "Prio_2_Day" exists for indicating the second signal aspect and could be executed if the first signal aspect was switched off.

It is now assumed by way of example in FIG. 6 that at time instant t3, a third control command "Prio_3_Day" is transmitted from the signal box 20 via the signal box line L3. Thus a total of three control commands exists at the signal transmitter 10, namely "Prio_1_Day", "Prio_2_Day" and "Prio_3_Day". In this case the drive device 12 of the signal transmitter 10 according to FIG. 5 will continue the display of the first signal aspect, which defines the safest state, and will switch on the first luminous element LEU1. The display of the first signal aspect is transmitted to the signal box 20 via the first signal box line L1 by transmitting the acknowledgement information "Prio_1_Day_ok".

In respect of the two other control commands "Prio_2_Day" and "Prio_3_Day", the signal transmitter 10 will generate error signals and transmit the same to the signal box 20, by, with the aid of the acknowledgment module 121 according to FIG. 5, the acknowledgment information "Prio_2_Error" and "Prio_3_Error" being transmitted to the signal box 20 by way of the two signal box lines L2 and L3. Information thus exists in the signal box 20 such that the first signal aspect is correctly indicated by the first luminous element LEU1. Furthermore, the information exists that two further control commands exist on the signal transmitter 10, which may actually not be the case. In order to eliminate the error, a warning signal can be generated for instance on the signal box side, which allows the operating personnel to examine the signal transmitter 10 or the signal box lines L1 to L3 for an error.

In the exemplary embodiment according to FIG. 6, it is now assumed that at time instant t4, the transmission of the control command "Prio_1_Day" is terminated. Only control commands "Prio_2_Day" and "Prio_3_Day" thus still exist.

Since a lower-order signal aspect is transmitted with the control command "Prio_2_Day" than with the control command "Prio_3_Day", the signal transmitter 10 will execute the signal aspect, which is assigned to the control command "Prio_2_Day" and arrange the luminous arrangement LA accordingly. Section "b)" of FIG. 6 shows the corresponding visualization of the control command "Prio_2_Day".

The signal transmitter 10 will signal the correct display of the second signal aspect by sending back the acknowledgment information "Prio_2_Day_ok" via the signal box line L2 to the signal box 20.

Since the third signal aspect with the third luminous element LEU3 could also be indicated, the signal transmitter 10 will also additionally generate acknowledgement information "Prio_3_Day_ok" and transmit the same via the third signal box line L3 to the signal box 20.

If now at a subsequent time instant t5, the transmission of the control command "Prio_2_Day" is determined, only the control command "Prio_3_Day" for indicating the third signal aspect is still present at the signal transmitter 10.

The third signal aspect is indicated by the signal transmitter 10, by the third luminous element LEU3 being activated. The corresponding signaling is shown in section "b)" of FIG. 6 by specifying the control command "Prio_3_Day". The correct display of the signal aspect is transmitted by acknowledgement information "Prio_3_Day_ok" on the signal box line L3 to the signal box 20.

Figure 7:
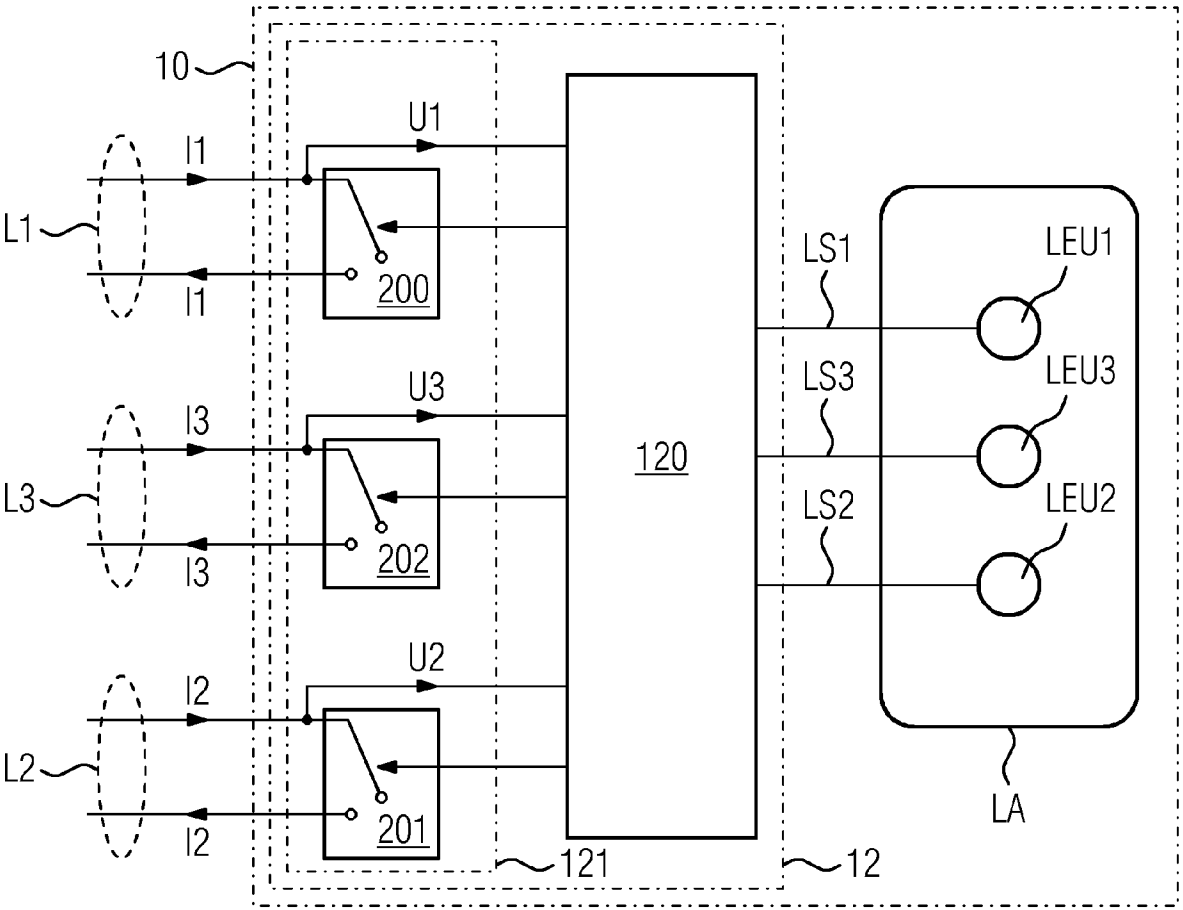

FIG. 7 shows by way of example an exemplary embodiment of a signal transmitter 10, in which generation of the acknowledgment information takes place by opening or closing switches 200, 201, and 202 using the lamp control module 120 of the signal transmitter 10. The three switches 200, 201 and 202 can form the acknowledgement module 121 according to FIG. 5.

The generation of acknowledgement information on the signal box lines L1, L2 and L3, which each include a forward conductor and a return conductor, takes place in this case as follows: if a control command in the form of a control voltage U1, U2 and U3 is transmitted from the signal box 20, this is evaluated by the lamp control module 120. A positive acknowledgement (cf. acknowledgement signals "Prio_1_Day_ok", "Prio_2_Day_ok" and "Prio_3_Day_ok" in FIG. 6) or execution of the corresponding control command is indicated by the lamp control module 120, by it closing the associated switch 200, 201 or 202. By closing the respective switch, a current flow I1, I2 and I3 is produced, which indicates to the signal box 20 that the respectively requested signal aspect or the associated luminous element or elements is/are or would be ready for operation. A current flow I1, I2 or I3 thus corresponds to an acknowledgment signal "Prio_1_Day_ok", "Prio_2_Day_ok" or "Prio_3_Day_ok" in FIG. 6.

By opening the respective switch, a current flow I1, I2 or I3 is interrupted so that in the event of a control voltage U1, U2 or U3 switched on by the signal box 20 being signaled thereto, the respectively requested signal aspect is not available or the associated luminous element or elements are not ready for operation or another error has occurred. An erroneous current flow I1, I2 or I3 with a switched-on control voltage U1, U2 or U3 thus corresponds to an acknowledgment signal "Prio_1_Error", "Prio_2_Error" or "Prio_3_Error" (cf. FIG. 6) on the respective signal box line L1, L2 or L3.

Actuation of the luminous elements LEU1 to LEU3 takes place immediately, namely by the lamp control module 120 by way of the lamp control lines LS1 to LS3.

Although the invention was illustrated and described in more detail by the preferred exemplary embodiments, the invention is not restricted by the disclosed examples and other variations can be derived herefrom by the person skilled in the art, without departing from the protective scope of the invention.

The invention claimed is:

1. A signal transmitter, comprising:

luminous elements including at least one first luminous element and at least one second luminous element;

an interface for connecting the signal transmitter to a signal box; and a drive device connected between said interface and at least two of said luminous elements, in an event of a switch-on signal coming from the signal box for said second luminous element, said drive device controlling an activation of said second luminous element in dependence on a signaling state of said first luminous element.

2. The signal transmitter according to claim 1, wherein a first signal aspect is assigned to said first luminous element and a second signal aspect is assigned to said second luminous element, wherein the second signal aspect is of higher order than the first signal aspect and wherein a luminous color of said first and second luminous elements is different.

3. The signal transmitter according to claim 1, wherein in the event of the switch-on signal coming from the signal box for said second luminous element, with an already switched-on said first luminous element, said drive device leaves said first luminous element switched on and said second luminous element switched off and said drive device generates an acknowledgement on said interface, the acknowledgement indicates to the signal box at least one of an operation or operational readiness of said first and second luminous elements, although said second luminous element is still switched off.

4. The signal transmitter according to claim 3, wherein said drive device first switches on said second luminous element, if said drive device receives a signal from the signal box for switching off said first luminous element.

5. The signal transmitter according to claim 1, wherein in an event of a presence of switch-on signals for both said first and second luminous elements on a signal box side, said drive device generates an error signal for the signal box for longer than a predetermined time span.

6. The signal transmitter according to claim 5, wherein said drive device generates the error signal on a control line on the signal box side for said second luminous element assigned to the second signal aspect.

7. The signal transmitter according to claim 1, further comprising at least one third luminous element for indicating a signal aspect, an order rating of which lies between that of the second signal aspect and that of the first signal aspect, and in an event of a presence of switch-on signals on a signal box side, said drive device generates an error signal for the signal box for at least three said luminous elements on said interface.

8. The signal transmitter according to claim 7, wherein said drive device generates the error signal on all control lines on the signal box side, on which switch-on signals exist on the signal box side, with an exception of a control line for said luminous element, which is assigned to a lowest-order signal aspect.

9. The signal transmitter according to claim 1, wherein the signal transmitter allows for daytime and nighttime signaling and said drive device generates an error signal if a signaling for daytime and nighttime operation exists at a same time.

10. A method for operating a signal transmitter having at least two luminous elements and an interface, and is connected to a signal box, which comprises the steps of:

connecting a drive device between the interface and the at least two luminous elements, in an event of a switch-on signal coming from the signal box for a second luminous element assigned to a second signal aspect, the drive device controlling activation of the luminous element in dependence on a signaling state of a first luminous element.

* * * * *